US006263778B1

(12) United States Patent
Brass et al.

(10) Patent No.: US 6,263,778 B1
(45) Date of Patent: Jul. 24, 2001

(54) PRECISION LIQUID INJECTION SYSTEM

(75) Inventors: Jack Brass, North York; William G. L. Knecht, Mississauga, both of (CA)

(73) Assignee: 117180 Ontario Limited (CA)

( * ) Notice: Subject to any disclaimer, the term of this patent is extended or adjusted under 35 U.S.C. 154(b) by 0 days.

(21) Appl. No.: 09/185,814

(22) Filed: Nov. 3, 1998

Related U.S. Application Data

(60) Provisional application No. 60/064,172, filed on Nov. 4, 1997.

(51) Int. Cl.[7] ..... F01B 3/00; B67D 5/42

(52) U.S. Cl. ..... 92/32; 222/390

(58) Field of Search ..... 92/31, 32, 33; 222/390

(56) References Cited

U.S. PATENT DOCUMENTS

| | | | | |
|---|---|---|---|---|
| 736,263 | * | 8/1903 | James | 222/390 X |
| 1,055,028 | * | 3/1913 | Flynn et al. | 222/390 X |
| 1,220,033 | * | 3/1917 | Vore | 222/390 X |
| 1,569,268 | * | 1/1926 | Dupre | 222/390 X |
| 1,716,482 | | 6/1929 | Bradbury . | |
| 1,926,399 | | 9/1933 | Nielsen . | |
| 1,984,865 | | 12/1934 | Creveling . | |
| 2,240,870 | | 5/1941 | Starr . | |
| 2,328,363 | | 8/1943 | Sundholm . | |
| 2,771,217 | * | 11/1956 | Brown et al. | 222/390 X |
| 2,826,040 | * | 3/1958 | Dussumier De Foet et al. | 92/31 |
| 2,946,486 | * | 7/1960 | Gilmont | 222/390 X |
| 3,799,406 | | 3/1974 | St. John et al. . | |
| 4,139,127 | * | 2/1979 | Gentile | 222/390 |
| 4,197,884 | | 4/1980 | Maran . | |
| 4,388,011 | * | 6/1983 | Smith | 222/390 |
| 4,457,641 | * | 7/1984 | Smith | 222/390 X |
| 4,544,083 | * | 10/1985 | Schroeder | 222/390 X |
| 4,623,337 | * | 11/1986 | Maurice | 222/390 X |
| 4,681,524 | | 7/1987 | Ikeda et al. . | |
| 4,738,826 | * | 4/1988 | Harris | 222/390 X |
| 4,863,072 | * | 9/1989 | Perler | 222/390 |
| 4,941,520 | | 7/1990 | Dowzall et al. . | |
| 4,948,016 | | 8/1990 | Summons et al. . | |
| 5,626,566 | * | 5/1997 | Petersen et al. | 222/390 X |
| 5,673,722 | | 10/1997 | Brass . | |
| 5,826,636 | | 10/1998 | Trigiani . | |
| 6,050,310 | | 4/2000 | Trigiani . | |

OTHER PUBLICATIONS

Classic Tool Design, Inc., "Hand Turn Dye Injectors", Models 22–1665, 22–1663 and 22–1661, Product Information Sheet, undated, 1 page.

* cited by examiner

*Primary Examiner*—John E. Ryznic
(74) *Attorney, Agent, or Firm*—Katten Muchin Zavis

(57) ABSTRACT

A liquid injector comprising a tubular spindle having an open end and a partially closed end, a cylindrical piston, a seal mechanism between the spindle and the piston, a tubular driver sleeve to cause the piston to move towards the spindle closed end, and an internal ratchet mechanism located between the piston and a closed end of the tubular driver sleeve for controlling the degree of rotation of the driver sleeve and providing a positive indication of driver sleeve rotation.

15 Claims, 2 Drawing Sheets

PRECISION LIQUID INJECTION SYSTEM

This application claims the benefit of Provisional No. 60/064,172 Nov. 4, 1998.

FIELD OF THE INVENTION

The invention relates to devices for injecting liquid into pressurized systems. More particularly, it relates to such devices for injecting liquids into air conditioning systems.

BACKGROUND OF THE INVENTION

Air conditioning systems often leak refrigerant. This is undesirable as the system will not operate efficiently with reduced quantities of refrigerant. The refrigerant needs to be replaced. It is also undesirable as refrigerant can be environmentally damaging when released.

Leak detection is generally performed by injecting a fluorescent dye into the air conditioning system. Typically dyes used for this purpose fluoresce in the ultraviolet or near ultraviolet region from approximately 360 to 420 nm; so, an ultraviolet light is shone on the system. Wherever leaks occur the dye will escape the system and fluoresce under the light. A pulsing ultraviolet light for this purpose is described in the inventor's copending U.S. patent application Ser. No. 08/417,234 filed Apr. 5, 1995, and continuations thereof, entitled Fault Locating Device, System and Method. Many other ultraviolet lights are available.

A number of injectors have been developed for getting liquids into an air conditioning system. Some injectors may also be used to inject other liquids, for example, refrigerant or lubricant into the air conditioning system.

U.S. Pat. No. 4,745,772 issued May 24, 1988 to Ferris describes a chemical additive device. The device has a container that unscrews to allow access to the interior for pouring in the additive. The container is screwed back together, the device is connected to the air conditioning system and the additive is injected under pressure from an external charging system.

U.S. Pat. No. 4,938,063 issued Jul. 3, 1990 to Leighley discloses a mist infuser for infusing a fluorescent dye into an air conditioning system. The Leighley infuser has two concentric glass cylinders sandwiched between two circular end caps. Together the end caps and the small cylinder define a reservoir. One end cap has a circular inlet through its centre, while the other has an outlet. An inlet bore opens from the outlet, perpendicular to it, through the circumference of the outlet end cap. Similarly, an outlet bore opens to the inlet from the circumference of the inlet end cap. The bores have respective sealing caps.

In operation, the infuser is turned on its side and the sealing caps are removed. The dye is added through the inlet bore, while air escapes through the outlet bore. The level of the dye is visible through the glass cylinders. The dye is injected under pressure from an external charging system.

In copending application Ser. No. 08/385,643, of one of the inventors of the instant application, Jack Brass, describes an injector having a tubular body surrounding and shielding a glass tube. The body and tube are sealed at opposing ends by a valve coupler and an end fill cap, each with there own O-ring seals. There are three openings through the body to allow for viewing of the contents of the tube, and to allow for light to pass into the tube. The injector is connected at the valve coupler through a hose and an on-off valve to the low side of an air conditioning system. It is connected through the end fill cap to a refrigerant charging system. The valve is shut off and the end fill cap is removed. The body is held upright and the liquid to be injected is poured into the glass tube. The fill end cap is replaced and the valve turned on. An external charging system propels the liquid into the air conditioning system. The tube can be viewed through the openings to determined that a sufficient quantity of the liquid has been propelled from the injector.

As described in a continuation-in-part of the previously mentioned copending application, Jack Brass also teaches that an inline injector can be used as part of an injection loop for injecting liquids into an air conditioning system having a low pressure side port and a high pressure side port. The loop has a first fitting compatible with the low pressure side port, a first control valve, an inline injector having a reservoir for holding a quantity of the liquid, a second control valve and a second fitting compatible with the high pressure side port. The fittings, valves and injector are in sealed fluid connection with one another in the order listed above when the control valves are in open positions. The first valve has an open position and a closed position, and the second valve has a closed position and is able to be opened to allow controlled release of the liquid when the first valve is in the open position.

The use of an injection loop and the pressure differential in the high to low pressure side ports allows liquid to be injected without the use of an external charging system.

Another injector system has been developed to avoid the use of an external charging system. P & F Technologies Limited of Toronto, Canada markets a SpotGun™ which is similar to a standard caulking gun. The gun uses a cartridge of 4 oz of fluorescent dye that is stated to be sufficient for 16 applications. The gun can be used for R12 and R134 dye. The cartridge is open and screws into a hose. The gun is operated by manually squeezing a movable trigger against a fixed handle. This forces the dye through the hose into the air conditioning system.

It is an object of the invention to address these or other problems, or to provide alternative devices, for the injection of liquids into pressurized systems.

SUMMARY OF THE INVENTION

In a first aspect the invention provides an injector for use in injecting a liquid into a pressurized system. The injector has a tubular spindle having a longitudinal axis, an open end, and an opposing partially closed end. The spindle open end and spindle closed end define a cylindrical bore along the longitudinal axis of the spindle. A cylindrical piston within the spindle bore is axially aligned with the longitudinal axis of the spindle. There are sealing means between the spindle and the piston. The spindle, piston and sealing means define a chamber between the piston and the spindle closed end within the bore. A tubular driver sleeve has a longitudinal axis, an open end and an opposing closed end. The driver sleeve has threads around an interior surface of the sleeve and the spindle has compatible threads around an exterior surface of the spindle such that rotation of the driver sleeve in one direction screws the driver sleeve towards the spindle closed end. This causes the piston to move towards the spindle closed end and exert pressure on the chamber.

Additional features of this aspect, and additional aspects of the invention, are further set out in the detailed description; provided that these additional features are only a preferred embodiment and other embodiments fall within the spirit and scope of the invention.

BRIEF DESCRIPTION OF THE DRAWINGS

For a better understanding of the present invention and to show more clearly how it may be carried into effect, reference will now be made, by way of example, to the accompanying drawings which show the preferred embodiment of the present invention and in which.

DETAILED DESCRIPTION OF THE PREFERRED EMBODIMENT

Figure 1:
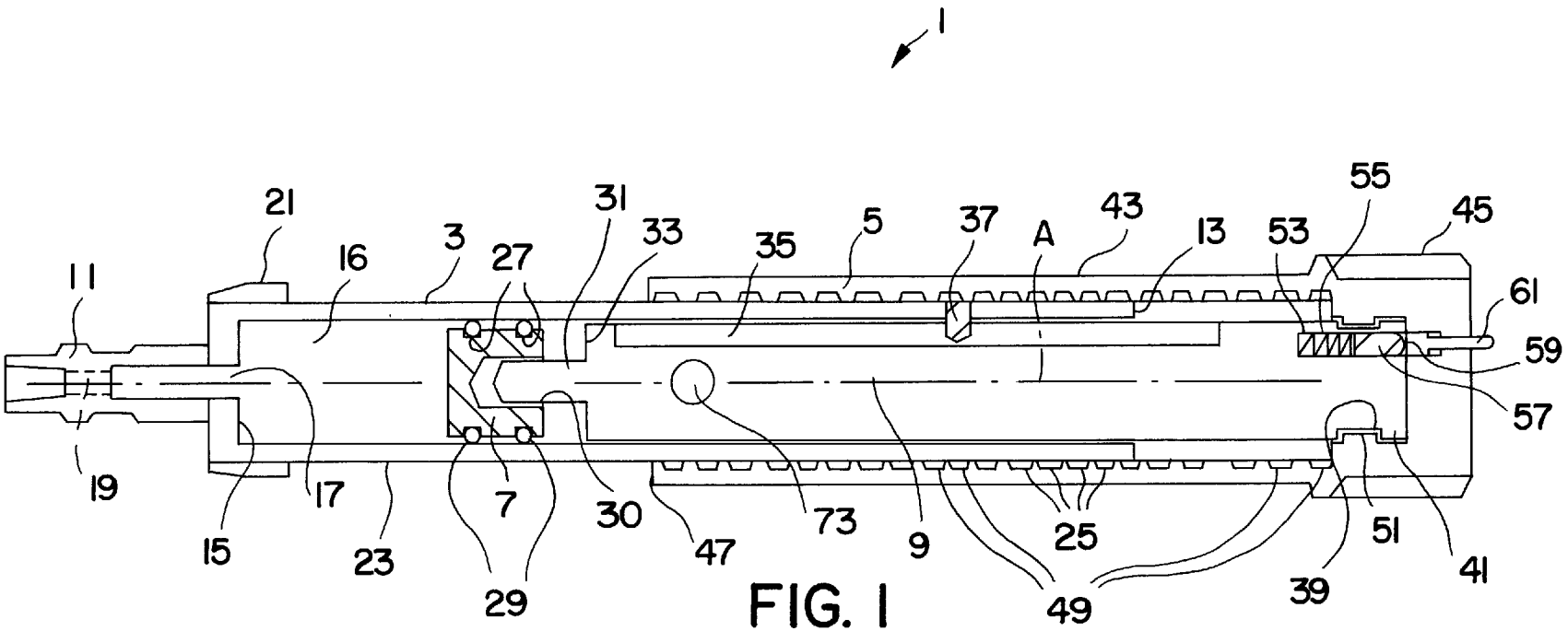
FIG. 1 is a cross section of an injector according to the preferred embodiment of the present invention.

Referring to FIG. 1, an injector 1 has a spindle 3, driver sleeve 5, piston 7, piston rod 9, and coupler 11.

The spindle 3 is tubular with a longitudinal axis aligned with a longitudinal access A of injector 1. The spindle has an open end 13 and housing partial closed end 15. The spindle 3 defines a cylindrical bore 16 along the longitudinal axis of the spindle 3 between the spindle ends 13,15.

The spindle end 15 opens through an outlet 17 into the coupler 11. The coupler 11 has a Schraeder-type valve 19 which prevents the flow of liquid from the spindle 3 through the coupler 11, unless the valve 19 is opened by a compatible external mechanism attached to the coupler 11 as will be described later below with reference to FIGS. 2 and 3.

The spindle 3 has a knurl 21 about the spindle closed end 15 and partially extending up the spindle 3 toward the spindle open end 13.

The spindle 3 has an exterior surface 23 with threads 25 about an upper portion of the spindle 3 towards the open end 13.

The piston 7 is cylindrical and fits within the bore 16. The piston 7 is axially aligned with the longitudinal axis of the spindle 3.

The piston 7 has annular grooves 27 into its surface about its axis. O-ring seals 29 fit into each of the grooves 27 in order to provide a positive seal against an interior surface of the spindle 3. The piston 7 has a partial cylindrical bore 30 along its axis opening away from the spindle closed end 15. Alternative pistons, not shown, could be moulded entirely from rubber with integral O-rings or wipes.

The piston rod 9 is cylindrical and fits within the spindle 3 bore 30. The rod 9 narrows to provide a tip 31 and shoulder 33. The tip 31 fits within the bore 30 of the piston 7 and the piston 7 rests against the shoulder 33.

A lock groove 35 extends into, and axially along, an exterior surface of the piston rod 9. A lock pin 37 extends from the interior surface of the spindle into the groove 35. The groove 35 and pin 37 are matched to allow movement of the piston rod 9 parallel to the axis of the spindle 3 while preventing rotation of the rod 9 with respect to the spindle 3.

About an end of the rod 9 opposite the tip 31 is an annular groove 39. The groove 39 defines a swivel 41.

The driver sleeve 5 is tubular. On its exterior surface the sleeve 5 has a grip section 43 extending outwardly into a knob 45. The grip section 43 has an open end 47, while the knob 45 provides a closed end to the sleeve 5. On an interior surface of the sleeve 5 are threads 49 extending for much of the length of the grip section 43. The threads 49 and threads 25 are compatible such that rotational movement of the sleeve 5 in one direction with respect to the spindle 3 will cause the sleeve 5 to move towards the closed end 15. The threads 49 and threads 25 are trapezoidal to increase the strength of the threads to withstand lateral forces parallel to the longitudinal axis A of the injector 1.

On the interior surface of the sleeve 5 is an annular extension 51 into the groove 39 of the rod 9. The extension 51/groove 39 combination holds the sleeve 5 and rod 9 fixed to prevent relative motion along the longitudinal axis A, while allowing rotational movement..

A bore 53 extends into the rod 9. A spring 55 and plunger 57 are placed within the bore 53. A ratchet 59 extends into the sleeve 5 such that when the plunger 57 and ratchet 59 are aligned the plunger 57 extends into the ratchet 59 by force of the spring 55. When the sleeve 5 is rotated with respect to the rod 9 such that the threads 49 and 25 force the sleeve 5 towards the closed end 15, the plunger 57 is allowed to slide out of the ratchet 59. When the sleeve 5 is rotated in the opposite direction the ratchet 59 will provide a stop for the plunger 57 and prevent further rotation.

A ratchet release button 61 can be provided through the sleeve 5 to allow the plunger 57 to be pushed back into the bore 53 and pass over the ratchet 59. Before providing a ratchet release feature, one should consider the advisability of allowing the user to rotate the sleeve 5 to allow the sleeve 5 to move away from the closed end 15. In many circumstances, it is preferable to provide a one-way mechanism which will not allow the user to reuse the injector 1.

Alternatively, the ratchet 59 may be a bore that receives the plunger 57 and holds it fixed until the ratchet release 61 is pushed. This provides a positive indication of a release of a fixed amount of liquid from the injector 1. In this embodiment, it may be important to utilize the "floating" piston feature described below to ensure that the piston 7 does not back away from the closed end 15 through an inadvertent reverse rotation of the sleeve 5 while the ratchet release 61 is pushed.

In operation, the injector 1 is pre-filled through the coupler 11 with liquid, such as a fluorescent dye for injection into an air conditioning system, not shown. Examples of other liquids could be chemical additives and refrigerant lubricants (oil).

Figure 2:
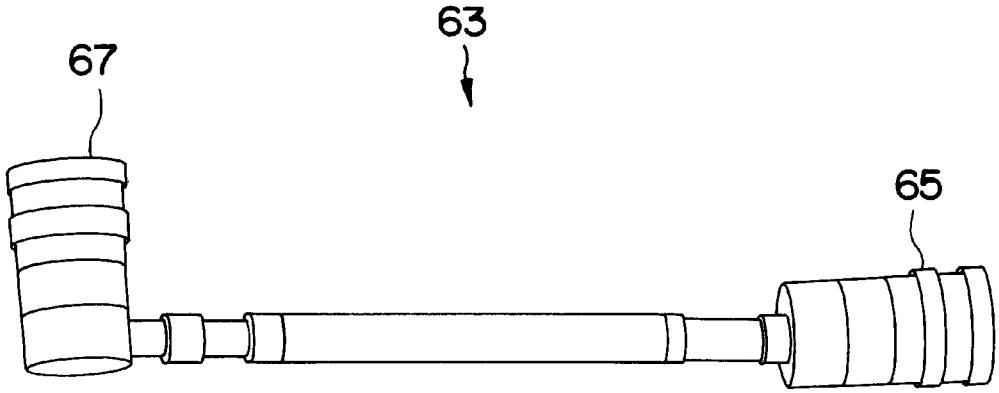
FIG. 2 is a coupling hose for use with the injector of FIG. 1.

The injector 1 is coupled by way of coupler 11 to a hose, such as hose 63 shown in FIG. 2. The hose 63 has a quick connect valve 65 at one end which does not allow liquid in the hose to escape unless the valve is opened by a compatible mechanism, such as coupler 11 hose 63 has a second quick connect valve 67 at an opposite end. The valve 67 is compatible with a low side fitting of an R134A air conditioning system, not shown.

Figure 3:
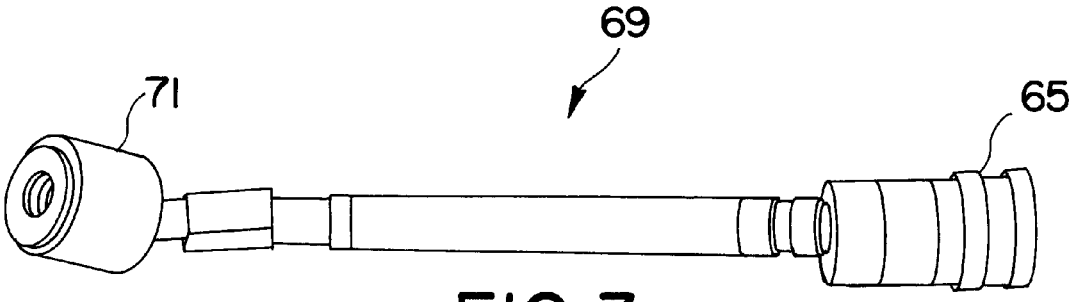
FIG. 3 is an alternate coupling hose for use with the injector of FIG. 1.

Alternatively, the injector 1 could be coupled to a hose 69 as shown in FIG. 3. The hose 69 has a coupler 65 for coupling to the coupler 11 and a coupler 71 for coupling to the low side of an R12 or R22 air conditioning system, not shown.

Figure 4:
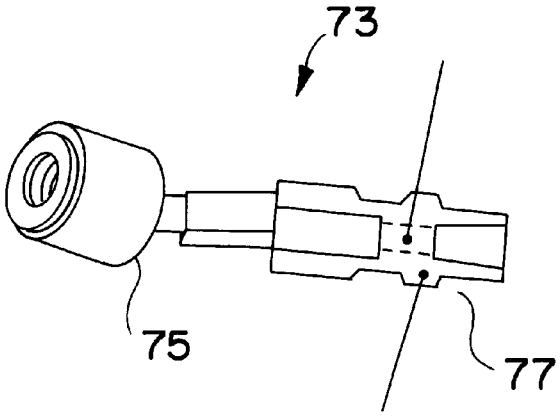
FIG. 4 is a coupling adaptor for use with the hose of FIG. 2.

As an alternative to the hose 69, a coupling adaptor 73 as shown in FIG. 4 could be used in combination with the hose 63 for coupling between the coupler 67 and an R12/R22 air conditioning system. The adaptor 73 has, back to back, a R12/R22 female fitting 75 and R134A male fitting 77. The fittings 75, 77 are preferably made from metal to allow for multiple uses and are joined by a short hose or other connecting means.

When they are coupled, the couplers 11, 63 or 69, 71 allow the free flow of liquid from the injector through the hose into the air conditioning system. When coupled, the couplers 11, 63 or 69, 71 do not require additional pressure to open their internal valves.

When coupled with the low side of an air conditioning system, not shown, an operator simply holds the knurl 21 and twists the sleeve 5 at the grip section 43. This causes the driver sleeve 5 to move towards the closed end 15 and provides pressure to the piston 7 through the rod 9. This forces the liquid through the outlet 17, coupler 11 and hose 63 or 69 into the air conditioning system. If required, the grip 43 and knurl 21 can be increased in diameter to make it easier to turn the sleeve 5. Alternatively, or in addition, the angle of the threads 49 and 25 can be adjusted.

The threads 49 and threads 25 can provide a very precise mechanism for injecting liquids. This allows for higher concentrations of dye to be used in the injector 1. This results in a smaller injector 1 or an injector 1 that can be used more times for a given capacity. Normally, ½ oz or 7.5 ml portions of dye, and dye carrier, are used for a 2 ½ lb. air-conditioning system; such as that in a typical passenger car. Using a precision injector 1, this can be concentrated so that only 2 ml, for example, are injected for use in a 2 ½ lb. system. Less carrier material is injected into the air conditioning system. Many carriers, such as PAG lubricants, are hydroscopic. Using less carrier reduces the possibility of water contamination of the air-conditioning system. Also, some manufacturers of air-conditioning systems specify a recommended type or brand of 134A PAG lubricant for use with their systems. The reduction of PAG lubricant as a carrier reduces the possibility of incompatibility between the injected PAG lubricant and the host PAG lubricant.

In fact, less liquid may be required for injection into an air conditioning system than resides within a hose 63 or 69. With the combination of valves at each end of the hose 63 or 69, dye from past uses is retained within the hose 63 or 69 and is simply forced from the hose 63 or 69 into the air conditioning system, and replenished by, the liquid from the injector 1.

Factory filling and the combination of valves minimizes loss of the liquid and possible contamination. Contaminants, including air, can introduce instabilities into an air-conditioning system with potentially disastrous consequences.

It is preferable to design the injector 1 for one turn per required amount to be injected. In this case, the snap of the plunger 57 provides a positive click on each rotation and a window or lens 73 in the sleeve 5 can show numbers reflecting the amount of liquid used or remaining. It is possible to utilize these features when other amounts of liquid are required per injection; however, they may be more complex, and not provide each of the design features, as would be evident to a person skilled in the art.

As the piston 7 is not connected to piston rod 9, it "floats"; so that, the piston 7 will not back away from the closed-end 15 if the sleeve 5 is rotated away from the closed-end 15. In alternative embodiments, the piston and piston rod 9 could be integrally moulded to form a single elongate piston, not shown, if desired.

The sleeve 5 and spindle 3 can be clear or opaque in order to view the liquid in the injector 1. Suitable materials for the sleeve 5, spindle 3, piston 7 and piston rod 9 include PET plastic and other such materials which can withstand the required pressures and will not degrade in contact with flourescent additives or refrigerant lubricants. For automotive air-conditioning units, the pressure is in the order of 120 psi. Plastic is particularly well-suited for the injector 1 when the injector 1 is intended to be non-reusable.

The spindle 3, sleeve 5, piston 7, piston rod 9, and coupler 11 can be injection moulded. It may be preferable to mould the components as two sections cut longitudinally along the axis of the injector 1 and attach the two halves using known techniques. The valve 19 can be inserted into the coupler 11 when the halves of the coupler are attached to one another. Similarly, the piston rod 9 can be inserted into sleeve 5 when the sleeve 5 halves are attached to one another.

The coupler 11 may be separate from and later attached to the spindle 3. Alternatively, the coupler 11 made be moulded together with the spindle 3.

The injector 1 provides a sealed, integral container and motive force. It does not require any additional tools or accessories for injection, beyond the hose 63 or 69. The coupler 11 could be replaced by a coupler 67 or 71 to provide direct injection into an air-conditioning system. This is not the preferred embodiment as it would require different injectors for R134A and R12/R22 or other systems. As well, attaching a hose 63 or 69 to an air-conditioning system and an injector 1 will be more comfortable and less cumbersome in most circumstances.

It will be understood by those skilled in the art that this description is made with reference to the preferred embodiment and that it is possible to make other embodiments employing the principles of the invention which fall within its spirit and scope as defined by the following claims.

What is claimed is:

1. A liquid injector, comprising:

a tubular spindle having a longitudinal axis, an open end, and an opposing partially closed end, the spindle open end and spindle closed end defining a cylindrical bore along the longitudinal axis of the spindle;

a cylindrical piston within the spindle bore axially aligned with the longitudinal axis of the spindle;

sealing means between the spindle and the piston, the spindle, piston and sealing means defining a chamber between the piston and the spindle closed end within the bore;

a tubular driver sleeve having a longitudinal axis, an open end and opposing closed end, the driver sleeve having threads around an interior surface of the sleeve and the spindle having compatible threads around an exterior surface of the spindle such that rotation of the driver sleeve in one direction screws the driver sleeve towards the spindle closed end to cause the piston to move towards the spindle closed end and exert pressure on the chamber; and internal ratchet means located between the piston and the closed end of the tubular driver sleeve for controlling the degree of rotation of the driver sleeve and providing a positive indication of driver sleeve rotation.

2. The liquid injector as claimed in claim 1, further comprising at least one window located in a longitudinal portion of the tubular driver sleeve, the window revealing one of a series of numerals reflecting the amount of liquid used or remaining.

3. The liquid injector as claimed in claim 1, further comprising a means for manually releasing the ratchet means.

4. The liquid injector as claimed in claim 3, further comprising at least one window located in a longitudinal portion of the tubular driver sleeve, the window revealing one of a series of numerals reflecting the amount of liquid used or remaining.

5. The liquid injector as claimed in claim 3, wherein the ratchet means comprises:

a plunger bore in the end of the piston that corresponds to the closed end of the tubular driver sleeve;

a plunger member located within the plunger bore;

at least one ratchet bore in the closed end of the tubular driver sleeve; and a spring located within the plunger bore for applying a force to the plunger member to cause the plunger member to engage the ratchet bore when the plunger bore and ratchet bore are brought into alignment by the rotation of the driver sleeve.

6. The liquid injector as claimed in claim 5, further comprising at least one window located in a longitudinal portion of the tubular driver sleeve, the window revealing one of a series of numerals reflecting the amount of liquid used or remaining.

7. The liquid injector as claimed in claim 5, wherein the manually releasable means comprises a ratchet release member located within a portion of the ratchet bore, whereby the ratchet release member may be used to push the plunger member out of the ratchet bore and into the plunger bore to permit rotation of the driver sleeve.

8. The liquid injector as claimed in claim 7, further comprising at least one window located in a longitudinal portion of the tubular driver sleeve, the window revealing one of a series of numerals reflecting the amount of liquid used or remaining.

9. The liquid injector as claimed in claim 3, wherein the ratchet means prevents the tubular driver sleeve from rotating in a direction that causes the tubular driver sleeve to move away from the spindle closed end.

10. The liquid injector as claimed in claim 9, further comprising at least one window located in a longitudinal portion of the tubular driver sleeve, the window revealing one of a series of numerals reflecting the amount of liquid used or remaining.

11. The liquid injector as claimed in claim 9, wherein the ratchet means comprises:

a plunger bore in the end of the piston that corresponds to the closed end of the tubular driver sleeve;

a plunger member located within the plunger bore;

at least one ratchet extending into the closed end of the tubular driver sleeve; and a spring located within the plunger bore for applying a farce to the plunger member to cause the plunger member to extend into the ratchet when the plunger bore and ratchet are brought into alignment by rotation of the tubular driver sleeve in a direction which causes the tubular driver sleeve to move towards the spindle closed end.

12. The liquid injector as claimed in claim 11, further comprising at least one window located in a longitudinal portion of the tubular driver sleeve, the window revealing one of a series of numerals reflecting the amount of liquid used or remaining.

13. The liquid injector as claimed in claim 11, wherein the manually releasable means comprises a ratchet release member provided through the closed end of the tubular driver sleeve, whereby the ratchet release member may be used to push the plunger member out of the ratchet to permit rotation of the tubular driver sleeve in a direction that causes the tubular driver sleeve to move away from the spindle closed end.

14. The liquid injector as claimed in claim 13, further comprising at least one window located in a longitudinal portion of the tubular driver sleeve, the window revealing one of a series of numerals reflecting the amount of liquid used or remaining.

15. A liquid injector, comprising;

a tubular spindle having a longitudinal axis, an open end, and an opposing partially closed end, the spindle open end and spindle closed end defining a cylindrical bore along the longitudinal axis of the spindle;

cylindrical piston within the spindle bore axially aligned with the longitudinal axis of the spindle;

sealing means between the spindle and the piston, the spindle, piston and sealing means defining a chamber between the piston and the spindle closed end within the bore;

a tubular driver sleeve having a longitudinal axis, an open end and opposing closed end, the driver sleeve having threads around an interior surface of the sleeve and the spindle having compatible threads around an exterior surface of the spindle such that rotation of the driver sleeve in one direction screws the driver sleeve towards the spindle closed end to cause the piston to move towards the spindle closed end and exert pressure on the chamber;

ratchet means for controlling the degree of rotation of the driver sleeve and providing a positive indication of driver sleeve rotation; and means for manually releasing the ratchet means, wherein the ratchet means comprises:

a plunger bore in the end of the piston that corresponds to the closed end of the tubular driver sleeve;

a plunger member located within the plunger bore;

at least one ratchet bore in the closed end of the tubular driver sleeve; and a spring located within the plunger bore for applying a force to the plunger member to cause the plunger member to engage the ratchet bore when the plunger bore and ratchet bore are brought into alignment by the rotation of the driver sleeve.

* * * * *